US007028406B2

(12) United States Patent
Polei

(10) Patent No.: US 7,028,406 B2
(45) Date of Patent: Apr. 18, 2006

(54) DEBURRING TOOL WITH REPLACEABLE BLADE

(75) Inventor: Gudula Polei, Solingen (DE)

(73) Assignee: Martor KG, Solingen (DE)

( * ) Notice: Subject to any disclaimer, the term of this patent is extended or adjusted under 35 U.S.C. 154(b) by 10 days.

(21) Appl. No.: 10/855,777

(22) Filed: May 27, 2004

(65) Prior Publication Data

US 2004/0250427 A1 Dec. 16, 2004

(30) Foreign Application Priority Data

Jun. 4, 2003 (DE) ..... 103 25 214

(51) Int. Cl.
*B26B 5/00* (2006.01)

(52) U.S. Cl. ..... 30/162; 30/169

(58) Field of Classification Search ..... 30/162, 30/169

See application file for complete search history.

(56) References Cited

U.S. PATENT DOCUMENTS

| | | | | |
|---|---|---|---|---|
| 931,778 | A * | 8/1909 | Levinsohn | 30/35 |
| 3,802,077 | A | 4/1974 | Averitt | |
| 4,226,020 | A * | 10/1980 | Quenot et al. | 30/162 |
| 4,604,805 | A | 8/1986 | Krieger | |
| 4,955,138 | A * | 9/1990 | Henke et al. | 30/169 |
| 5,121,544 | A * | 6/1992 | Gilbert | 30/162 |
| 5,168,630 | A | 12/1992 | Weber | |
| 5,598,634 | A | 2/1997 | Berns | |
| 5,996,231 | A * | 12/1999 | Roche et al. | 30/169 |
| 6,775,912 | B1 * | 8/2004 | Panfili et al. | 30/169 |
| 6,813,833 | B1 * | 11/2004 | Saunders et al. | 30/162 |
| 2003/0009887 | A1 * | 1/2003 | Cybulski | 30/162 |
| 2004/0045172 | A1 * | 3/2004 | Rowlay | 30/162 |

FOREIGN PATENT DOCUMENTS

| | | |
|---|---|---|
| DE | 197 49 256 | 5/1999 |

* cited by examiner

*Primary Examiner*—Charles Goodman
(74) *Attorney, Agent, or Firm*—Herbert Dubno; Andrew Wilford

(57) ABSTRACT

A knife body is formed with a front-end holding face and rearward therefrom with a transverse pivot and a longitudinal guide. A blade can fit with the body holding face and project from the body front end. A rocker on the pivot has another holding face and a pair of inner faces. The rocker is pivotal between a closed position with its holding face closely juxtaposed with the body holding face and pressing the blade against the body holding face and an open position with its holding face spaced from the blade and body holding face. A slide is engageable with the arm inner faces and is displaceable longitudinally along the guide between a front position engaging one of the arm inner faces and pivoting the rocker into the open position and a rear position bearing on the other arm inner face and holding the rocker in the closed position.

18 Claims, 4 Drawing Sheets

DEBURRING TOOL WITH REPLACEABLE BLADE

FIELD OF THE INVENTION

The present invention relates to a razor knife. More particularly this invention concerns a deburring tool with a displaceable blade.

BACKGROUND OF THE INVENTION

A deburring knife as described in U.S. Pat. No. 5,598,634 has a body extending along an axis, having a front end, and having a rear end formed with an outer surface. A hollow handle fitted over the rear end has an inner surface confronting the outer surface of the body, and a blade is affixed to the handle front end. One of the surfaces is formed with a row of angularly extending and axially spaced holding ridges having outer edges and defining a row of axially spaced, radially open, and angularly extending holding grooves each extending relative to the axis over substantially less than 360°, and an axially extending ridge-free guide. The other of the surfaces is formed with a radially projecting holding ridge engageable in the grooves and on the guide. The guide and ridges are so dimensioned that when the other-surface ridge is aligned in the guide the handle can move axially on the body.

Another knife is described in U.S. Pat. No. 5,168,630. It has a front end formed as a clamp in which a blade can be retained. The jaws of the clamp are connected to respective levers that are operable to spread these jaws and release the blade, so that it can be changed.

Both these knives are relatively handy, yet they are of fairly complex construction. Both are comprised of quite a few separate parts that must be meticulously assembled and that therefore raise the manufacturing costs for the knife. This is a particular problem for a tool that can often be damaged in use, for instance by contact with solvents, and that must be replaced often.

OBJECTS OF THE INVENTION

It is therefore an object of the present invention to provide an improved knife.

Another object is the provision of such an improved knife which overcomes the above-given disadvantages, that is which is of simple and inexpensive construction, yet where changing the blade is a simple task.

A further object is to provide such a knife which is of particularly slim construction.

SUMMARY OF THE INVENTION

A knife has according to the invention an elongated body having a front end formed with a transversely directed holding face and a rear end. The body is formed between its ends with a transversely extending pivot and with a longitudinally extending guide. A blade can fit with the body holding face in a position projecting longitudinally forward from the body front end. A rocker carried on the pivot has forward of the pivot a holding face confronting the body holding face and rearward of the pivot a pair of transversely confronting inner faces. The rocker is pivotal between a closed position with its holding face closely juxtaposed with the body holding face and pressing the blade against the body holding face and an open position with its holding face spaced from the blade and body holding face. A slide has a front end engageable in the notch with the arm inner faces and is displaceable longitudinally along the guide in the body between one end position engaging one of the arm inner faces and pivoting the rocker into the open position and an opposite end position bearing on the other of the arm inner faces and holding the rocker in the closed position. A latch secured to the body bears on the slide in the one end position thereof.

Such a knife is of extremely simple construction. It has four simple parts. The body and rocker, since they need to be fairly strong and durable, can be cast of light metal, and the slide and latch can be of plastic. Thus the knife can be made at very low cost, and its assembly and, if necessary, disassembly is a very simple operation requiring no tools. The blade is solidly locked in the closed position of the rocker so that the knife can be used to scrape, for instance as a deburring tool, without the blade coming loose. The pivotal action creates considerable clamping force, unlike the slide-type fit of the prior art.

According to the invention the rocker has a pair of transversely spaced arms each forming a respective one of the inner faces and both projecting away from the pivot. One of the inner faces is formed with a wedge-shaped bump projecting transversely toward the other of the inner faces and bearing on the slide front end in the one end position thereof. The slide front end is transversely offset. Thus as it moves back an angled face on the offset end engages the bump and pivots the rocker into the open position. When moved forward, the slide engage the opposite face and forces the holding faces together on opposite sides of the blade. To this end the slide front end has a pair of transversely oppositely directed outer faces respective engageable with the inner faces of the rocker.

The guides include at least one longitudinally extending ridge on the body. The slide is formed with a complementary longitudinally extending groove fitting with the ridge. Normally there are two such guide ridges and complementary grooves. Thus the slide is solidly mounted so that it can exert the necessary transverse force to hold the blade tightly, yet still moves easily longitudinally on the knife body.

This slide has according to the invention an edge provided with grip formations projecting past the body. These formations are a plurality of longitudinally spaced and transversely extending ridges.

In accordance with the invention the latch is basically J-shaped and body is formed at its rear end with a transversely projecting bridge to which the latch is clipped. Thus it is a very simple part.

The knife blade is formed with a throughgoing hole, and one of the holding faces is formed with a transversely projecting pin fittable through the hole and the other of the holding faces is formed with a transversely open seat in which the pin is engageable in the closed position. This solidly locks the blade in place in the closed position of the rocker.

The body is formed as a pair of parallel bars unitarily joined by front, middle, and rear bridges. The front bridge forms the body holding face, the middle bridge forms a pivot for the rocker, and the rear bridge carries the latch. Such construction is extremely durable, yet most of the outer surfaces of the knife are formed by the body. Normally according to the invention outer surfaces of the slide and rocker are flush with outer surfaces of the body in the closed position.

BRIEF DESCRIPTION OF THE DRAWING

The above and other objects, features, and advantages will become more readily apparent from the following description, reference being made to the accompanying drawing in which.

SPECIFIC DESCRIPTION

Figure 8A:
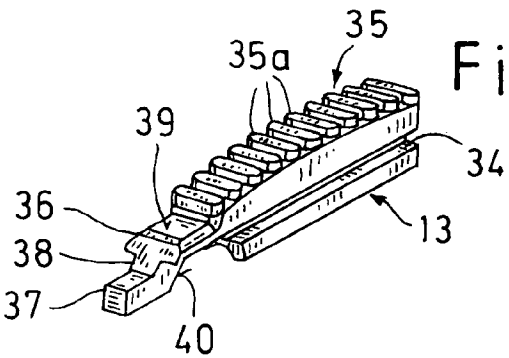
FIGS. 8 and 8A are side and perspective top views of the slide of the knife.
Figure 9A:
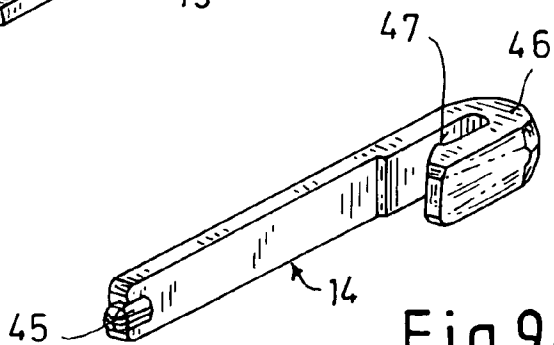
FIGS. 9 and 9A are side and perspective top views of the latch of the knife.

As seen in FIGS. 1 to 4, a deburring tool or knife 10 according to the invention has a body or handle 11, a rocker 12 (see also FIGS. 7 and 7A), a slide 13 (see also FIGS. 8 and 8A), a latch 14 (see also FIGS. 8 and 9A), and a replaceable blade 15. The parts 11 and 12 are made of a light metal, e.g. an aluminum, alloy, the parts 13 and 14 are molded of a durable plastic, and the blade 15 is typically of steel. The handle 10 has a pair of smooth and outwardly convex outer faces 11*a* and 11*b* formed by a pair of side pieces or bars 16 and 17 that themselves extend longitudinally but that are unitarily interconnected by four longitudinally spaced and transversely extending webs or bridges 18, 19, 20, and 21. The knife 10 has a front end 22 from which the blade 15 projects longitudinally and a rear end 23. The first or front bridge 18 has a face 18*a* forming one side of a blade clamp 26. The second bridge 19 is the pivot for the rocker 12. The third and fourth bridges 20 and 21 fit with the latch 14.

Figures 1, 2, 3, 4:
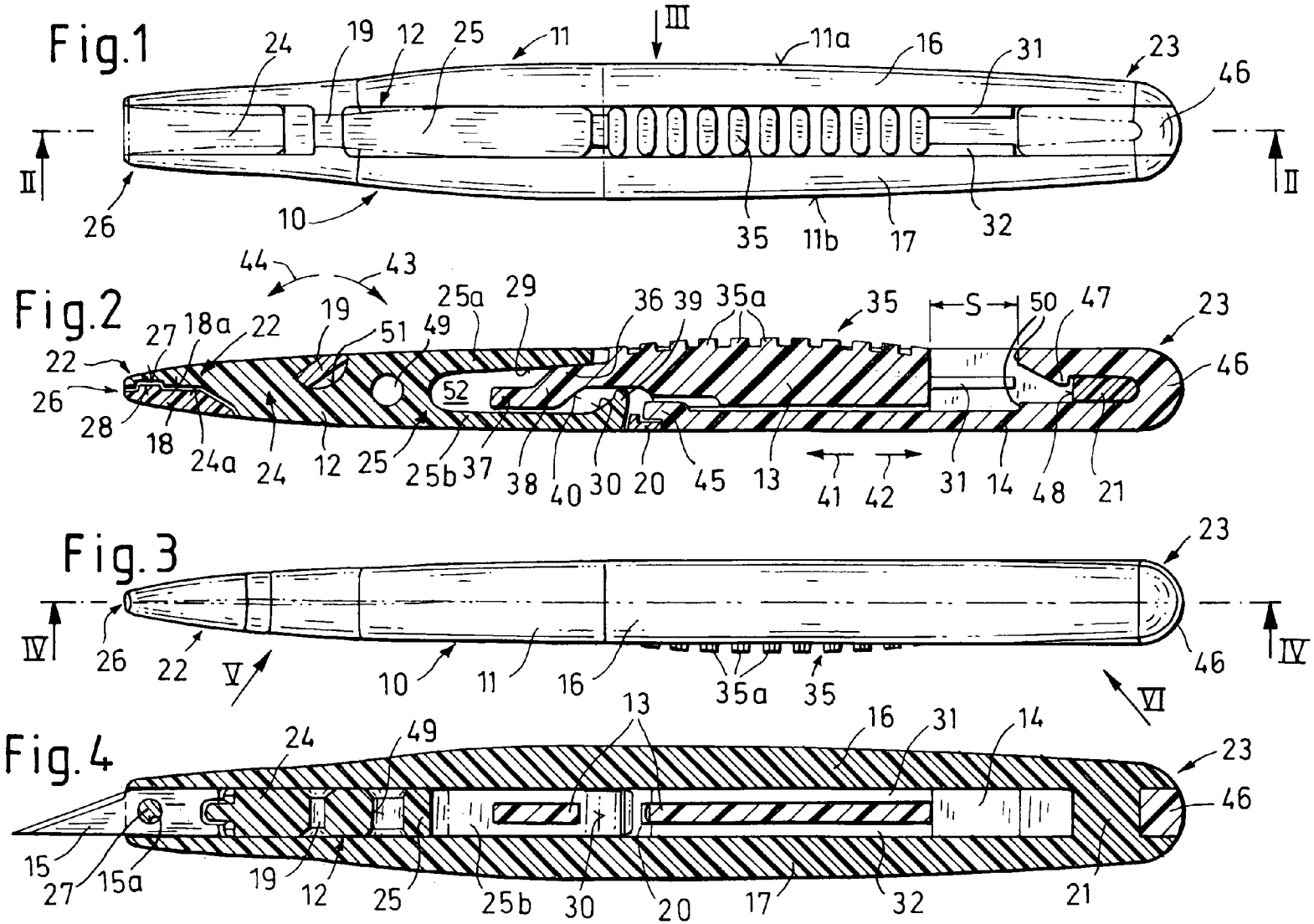
FIG. 1 is a top view of the knife.
FIG. 2 is a longitudinal section taken along line II—II of FIG. 1.
FIG. 3 is a side view taken in the direction of arrow III of FIG. 1.
FIG. 4 is a longitudinal section taken along line IV—IV of FIG. 3.
Figure 5:
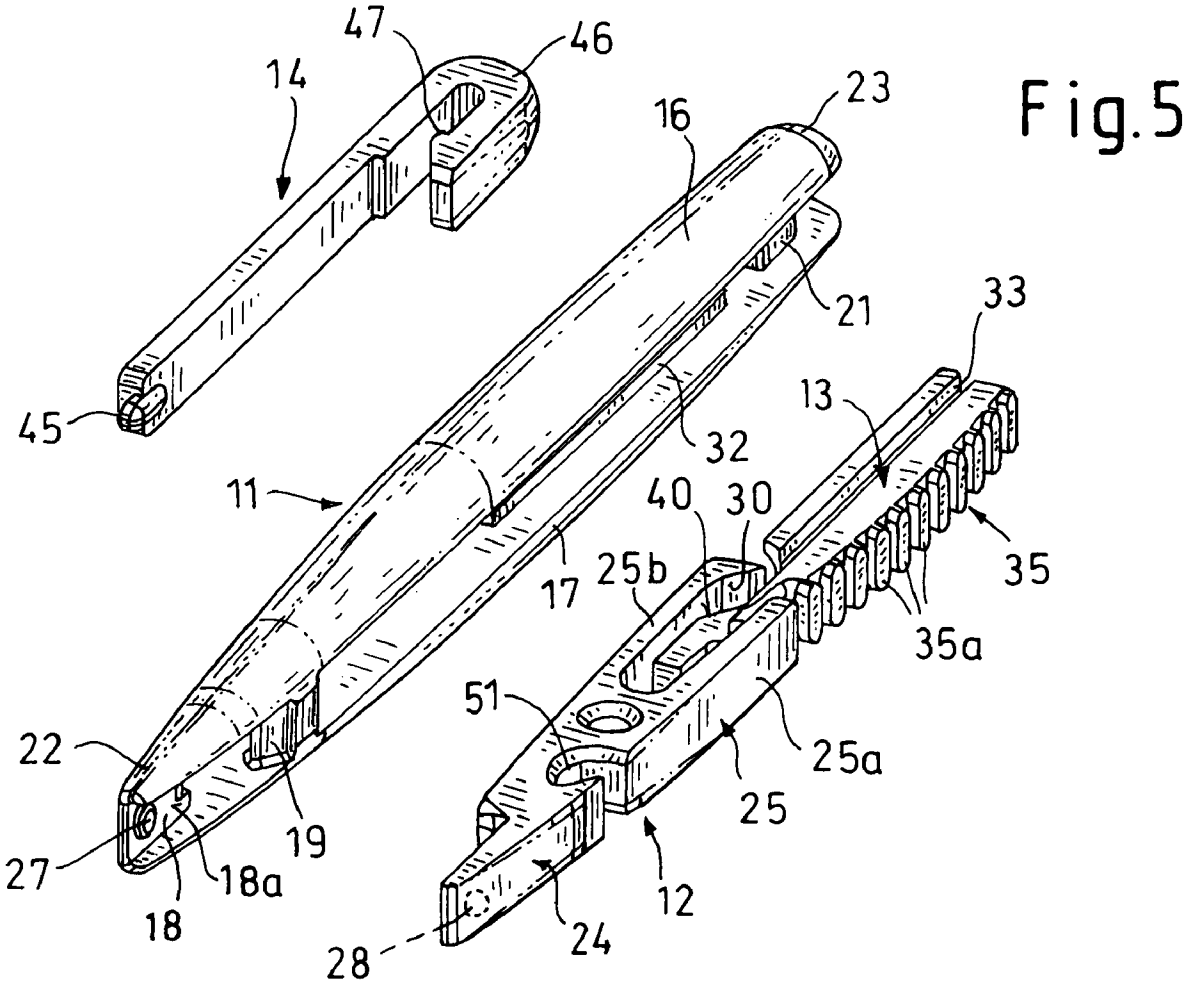
FIGS. 5 and 6 are exploded perspective views taken in the direction of respective arrows V and VI of FIG. 4.
Figure 6:
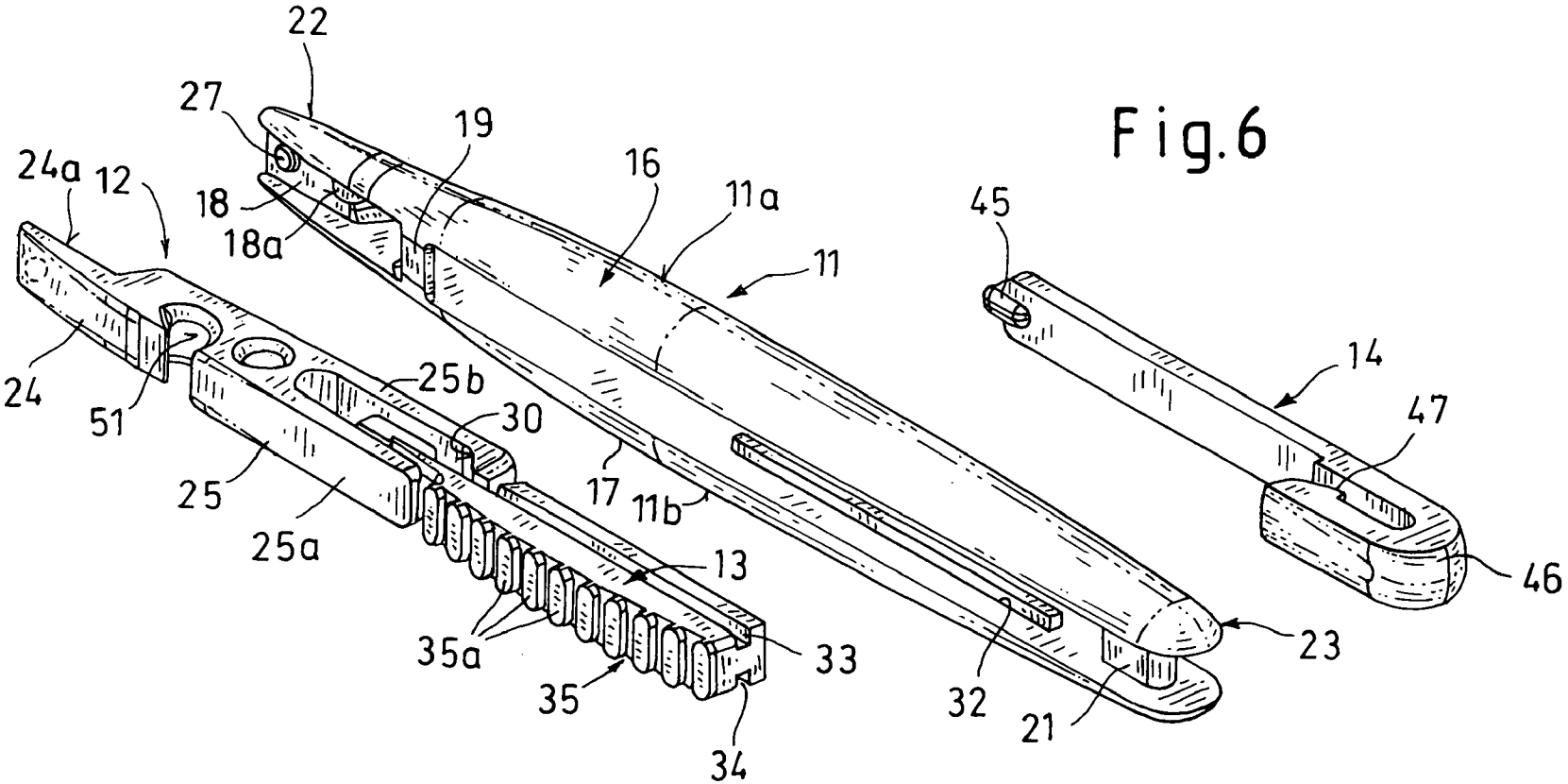
Figure 7A:
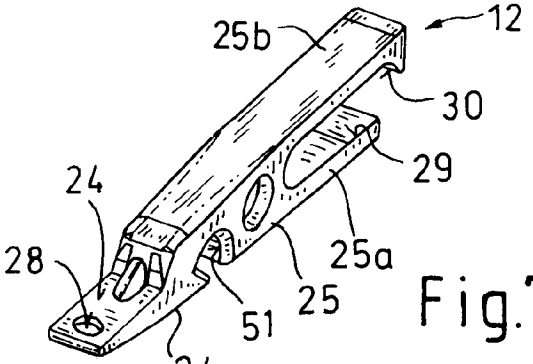
FIGS. 7 and 7A are side and perspective top views of the rocker of the knife.
Figure 7:
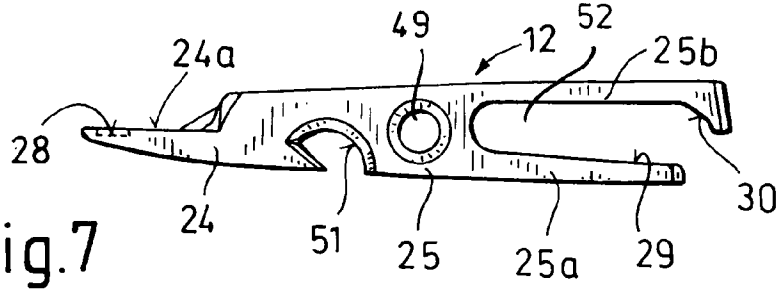

As also shown in FIGS. 7 and 7A, the rocker 12 is formed as a two-arm lever with a front part 24 and a back part 25. The part 24 is formed with a holding surface 24*a* that grips the blade 15 together with the holding surface 18*a*. A bump 27 on the surface 18*a* fits through a hole 15*a* (FIG. 4) in the blade 15 and into a seat 28 on the surface 24*a* to solidly lock the blade 15 in place when the rocker 12 is in the illustrated closed position. Centrally the rocker 12 has a cutout 51 that fits on the pivot bridge 19 and rearward of this cutout 51 it has a short arm 25*a* and a long arm 25*b* having inner faces 29 and 30 forming a rearwardly open seat or notch 52. The long arm 25*b* has at its rear end a wedge-shaped cam bump 39 projecting upward into the notch 52. Pivoting the rocker 12 clockwise as shown in FIG. 7 about the pivot bridge 19 separates the surfaces 18*a* and 24*a* from each other to allow the blade 15 to be removed and replaced. A transversely throughgoing hole 49 is provided to reduce the weight of the rocker 12.

Figure 8:
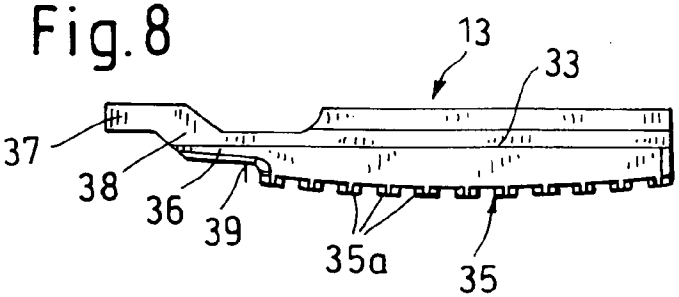
Figure 9:
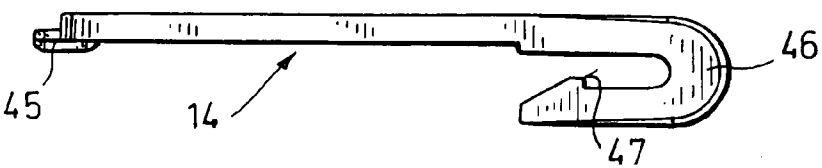

The slide 13 as shown in FIG. 8 is formed with a pair of longitudinally extending and oppositely transversely open guide grooves 33 and 34 that fit with complementary guide ridges 31 and 32 (see FIG. 4) formed on inner faces of the handle bars is 16 and 17 so that this slide 13 can shift limitedly longitudinally in the handle 11. It has a top surface 35 formed with a plurality of crosswise ridges or bumps 35*a* that facilitate such sliding and that project slightly above the adjacent surfaces of the handle 11. At its front end it is formed with a pair of transversely and longitudinally offset portions 36 and 37 joined by an angled web 38 and adapted to fit into the notch 52 and press against the inner surfaces 29 and 30 of the arms 25*a* and 25*b* in a forward retaining position corresponding to the closed position of the rocker 12. When in this forward retaining position, the slide 13 locks the rocker 12 against counterclockwise rotation into an unillustrated open position with the surfaces 18*a* and 24*a* spaced from each other sufficiently to allow the blade 15 to be switched.

Displacement of the slide 13 rearward in the direction of arrow 42 (FIG. 2) through a stroke S into an unillustrated rear position moves the very front end of the portion 37 slightly forward of the rear end of the short arm 25*a*. Such rearward displacement causes an angled lower face 40 of the web 38 to engage the inner surface 30 of the arm 25*b* and then the bump 39 to pivot the rocker 12 downward as shown by arrow 43, toward the open position. Thus to change a blade 15, the user need merely shift the slide 13 rearward with his/her thumb so as to open the clamp 26. To lock in the new blade, the slide 13 is shifted forward in direction 41, thereby pivoting the clamp 26 back in direction 44 to the illustrated closed position.

In order to prevent the slide 3 from pulling wholly out of the notch 52, it butts against front faces 50 (FIG. 2) of the latch 14. This latch 14 is basically J-shaped and has on its short leg a ridge or barb 47 so that it can be snapped in place over the rearmost or fourth bridge 21 and on its other long leg an offset front end 45 that fits in the third bridge 20. A web 46 joining the short and long legs fits complementarily over the rear edge of the bridge 21 with the barb 47 engaging a front edge 48 of this bridge 21.

The knife 10 can be assembled and disassembled easily without tools. To start with the slide 13 is snapped into place between the ridges 31 and 32, and then is moved all the way back so it butts against the face 48 of the web 21. Then the rocker 12 is hooked by its pivot cutout 51 over the web 19 and is pivoted down so its notch 52 is aligned with the front end 37 of the slide 13. The slide 13 is then slid forward, and the latch 14 is snapped into position on the rearmost bridge 21.

Disassembly is done in the reverse order. More specifically the short leg of the latch 14 is pried up so the latch 14 can be slipped back off the bridge 21. The slide 13 is then shifted back so it pulls completely out of the notch 52, whereupon the rocker 12 is pivoted and unhooked from the bridge 19. Then the slide 13 is simply pried out of the handle 11.

While the description above refers to a very slim deburring tool, of course the instant invention covers other tools having replaceable but fixedly mounted blades. A larger utility-knife blade or a special duty blade, e.g. a carpet hook, could be held in a somewhat fatter handle.

I claim:

1. A knife comprising:

an elongated body having a front end formed with a transversely directed holding face and a rear end, the body being formed between its ends with a transversely extending pivot and with a longitudinally extending guide;

a blade fittable with the body holding face in a position projecting longitudinally forward from the body front end;

a rocker carried on the pivot and having forward of the pivot a holding face confronting the body holding face and rearward of the pivot a pair of transversely confronting inner faces, the rocker being pivotal between a closed position with its holding face closely juxtaposed with the body holding face and pressing the blade against the body holding face and an open position with its holding face spaced from the blade and body holding face; and a slide having a front end engageable between the rocker inner faces, the slide being displaceable longitudinally along the guide in the body between one end position engaging one of the rocker inner faces and pivoting the rocker into the open position and an opposite end position bearing on the other of the rocker inner faces and holding the rocker in the closed position.

2. The knife defined in claim 1 wherein the rocker has a pair of transversely spaced arms each forming a respective one of the inner faces and both projecting away from the pivot.

3. The knife defined in claim 2 wherein one of the inner faces is formed with a bump projecting transversely toward the other of the inner faces and bearing on the slide front end in the one end position thereof.

4. The knife defined in claim 3 wherein the bump is wedge-shaped.

5. The knife defined in claim 3 wherein the slide front end is transversely offset.

6. The knife defined in claim 3 wherein the slide front end has a pair of transversely oppositely directed outer faces respective engageable with the inner faces of the rocker.

7. The knife defined in claim 1 wherein the guides include at least one longitudinally extending ridge on the body, the slide being formed with a complementary longitudinally extending groove fitting with the ridge.

8. The knife defined in claim 1 wherein the guides include a pair of transversely confronting and longitudinally extending ridges on the body, the slide being formed with complementary longitudinally extending and oppositely open grooves fitting with the ridges.

9. The knife defined in claim 1 wherein the slide has an edge provided with grip formations projecting past the body.

10. The knife defined in claim 9 wherein the grip formations are a plurality of longitudinally spaced and transversely extending ridges.

11. The knife defined in claim 1, further comprising a latch secured to the body and bearing on the slide in the one end position thereof.

12. The knife defined in claim 11 wherein the latch is basically J-shaped and body is formed at its rear end with a transversely projecting bridge to which the latch is clipped.

13. The knife defined in claim 1 wherein the blade is formed with a throughgoing hole, one of the holding faces being formed with a transversely projecting pin fittable through the hole and the other of the holding faces being formed with a transversely open seat in which the pin is engageable in the closed position.

14. The knife defined in claim 1 wherein the body is formed as a pair of parallel bars unitarily joined by a plurality of bridges one of which forms a pivot for the rocker.

15. The knife defined in claim 1 wherein another of the bridges at the front end forms the body holding face.

16. The knife defined in claim 1 wherein outer surfaces of the slide and rocker are flush with outer surfaces of the body in the closed position.

17. The knife defined in claim 1 wherein the body and rocker are of metal and the slide is of plastic.

18. A knife comprising:

an elongated body formed by a pair of parallel and longitudinally extending side parts and front, middle, and rear bridges unitarily formed with and extending transversely between the side parts, the body having a front end where the front bridge forms a transversely directed holding face and a rear end, the middle bridge forming a pivot between the body ends, the body being formed between the middle and rear bridge with a longitudinally extending guide;

a blade fittable with the body holding face in a position projecting longitudinally forward from the body front end;

a rocker carried on the pivot and having forward of the pivot a holding face confronting the body holding face and rearward of the pivot a pair of rearwardly projecting arms forming transversely confronting inner faces, the rocker being pivotal between a closed position with its holding face closely juxtaposed with the body holding face and pressing the blade against the body holding face and an open position with its holding face spaced from the blade and body holding face;

a slide between the rocker and the rear end and having a front end engageable in the notch with the arm inner faces, the slide being displaceable longitudinally along the guide in the body between a rear position engaging one of the arm inner faces and pivoting the rocker into the open position and an opposite front position bearing on the other of the arm inner faces and holding the rocker in the closed position; and a latch clipped over one of the bridges at the rear body end and bearing forwardly on the slide in the rear position.

* * * * *